United States Patent [19]

Matsuda et al.

[11] 4,230,470

[45] Oct. 28, 1980

[54] AIR CONDITIONING SYSTEM

[75] Inventors: Toshiharu Matsuda, Kudamatsu; Seigo Miyamoto, Takahagi; Yasuo Minoshima, Yamaguchi, all of Japan

[73] Assignee: Hitachi, Ltd., Tokyo, Japan

[21] Appl. No.: 870,821

[22] Filed: Jan. 19, 1978

[30] Foreign Application Priority Data

| | | | |
|---|---|---|---|
| Jan. 21, 1977 | [JP] | Japan | 52/4970 |
| Apr. 15, 1977 | [JP] | Japan | 52/46522 |
| Jul. 25, 1977 | [JP] | Japan | 52/88378 |

[51] Int. Cl.[2] ..... F25B 41/00

[52] U.S. Cl. ..... 62/197; 62/117

[58] Field of Search ..... 62/197, 117, 513, DIG. 17

[56] References Cited

U.S. PATENT DOCUMENTS

| | | | |
|---|---|---|---|
| 3,014,352 | 12/1961 | Leimbach | 62/197 |
| 3,698,202 | 10/1972 | Missimer | 62/197 |
| 3,877,242 | 4/1975 | Creager | 62/352 X |

FOREIGN PATENT DOCUMENTS

| | | | |
|---|---|---|---|
| 44-13735 | 6/1969 | Japan | 62/197 |
| 51-78456 | 6/1976 | Japan | 62/197 |

*Primary Examiner*—William E. Wayner
*Attorney, Agent, or Firm*—Thomas E. Beall, Jr.

[57] ABSTRACT

In an air conditioning system including a compressor, a condenser for condensing a refrigerant through heat exchange with outdoor air, an expansion valve, an evaporator for evaporating the refrigerant through heat exchange with air to be conditioned, and piping connecting these parts together to form a closed main circuit for the refrigerant, there is provided a bypass circuit connecting a point in the main circuit between the condenser and expansion valve to a point in the main circuit between the evaporator and compressor. The bypass circuit includes a relief valve adapted to open when the internal pressure of the condenser in the main circuit exceeds a predetermined level, pressure reducing means, and a heat exchanger for causing heat exchange to take place directly between the refrigerant in a high pressure section of the main circuit and the refrigerant having its pressure reduced by the pressure reducing means whereby an inordinate rise in the pressure of the refrigerant in the high pressure section of the main circuit due to a lowering in the capability of the condenser can be prevented.

12 Claims, 19 Drawing Figures

AIR CONDITIONING SYSTEM

LIST OF PRIOR ART REFERENCES [37 CFR 1.56(a)]

The following references are cited to show the state of the art:

Japanese Utility Model Publication No. 13735/69 June 9, 1969 M. Muramatsu et al.

Japanese Utility Model Publication No. 16826/72 June 13, 1972 K. Kimoto

Japanese Utility Model Laid-Open No. 131659/75 Oct. 29, 1975 Y. Udagawa

Japanese Utility Model Laid-Open No. 78456/76 June 21, 1976 T. Higuchi

U.S. Pat. No. 3,653,223 Apr. 4, 1972 Daniel F. Jones et al.

U.S. Pat. No. 3,633,376 Jan. 11, 1972 Robert G. Miner

U.S. Pat. No. 3,665,725 May 30, 1972 John W. Barlass et al.

This invention relates to air conditioning systems utilizing the refrigeration cycle having an air-cooled condenser, and more particularly to an air conditioning system having means for prevent an inordinate rise in condensing pressure due to a lowering in condensing capability caused by an abnormal rise in outdoor temperature.

Generally, an air conditioning system comprises a compressor, a condenser for changing a refrigerant to a liquid state through heat exchange with outdoor air, pressure reducing means, an evaporator for evaporating the refrigerant through heat exchange with air to be conditioned, and piping connecting these parts together to form a closed refrigerant circuit. The operation of the air conditioning system constructed as aforementioned will be outlined. A refrigerant in a gaseous state discharged from the compressor which is high in temperature and pressure passes through the piping to the condenser where it changes into a liquid state by being cooled by outdoor air. The refrigerant in a liquid state has its pressure reduced by the pressure reducing means and passes on to the evaporator while changing into a gaseous state. At the evaporator, the refrigerant is evaporated as it cools air in a space to be cooled, and the evaporated refrigerant is returned to the compressor for recompressing therein.

In the air conditioning system of the type described, a rise in outdoor temperature for cooling the condenser entails a rise in condensing pressure of the refrigerant in the condenser. A rise in condensing pressure causes a rise in discharge pressure of the refrigerant in the compressor. Meanwhile since the discharge pressure of the compressor is restricted by the strength of the discharge valve, there are limits to the outdoor temperature at which the air conditioning system can operate without any trouble.

Let us consider, as an example, an air-cooled air conditioning system using R-22 ($CHCLF_3$) as a refrigerant. The allowable discharge pressure of a compressor is generally about 26 kg/cm$^2$, so that the condensing pressure should be kept at about 25 kg/cm$^2$ by taking into consideration a loss of pressure between the compressor and condenser. The saturation temperature (or condensing temperature) of R-22 for the condensing pressure of 25 kg/cm$^2$ is about 62° C., and the difference between the condensing temperature of the refrigerant in an air-cooled condenser and the temperature of cooling air at the cooling air inlet is about 15° C. Therefore, the upper limit of outdoor temperature at which the air conditioning system described above can operate is about 47° C.

In this way, the type of refrigerant used determines the maximum outdoor temperature at which an air conditioning system can operate. Stated differently, it is impossible to continue the operation of an air conditioning system if and when the maximum allowable outdoor temperature is exceeded. In air cooling systems of the prior art, a pressure switch is provided for detecting the discharge pressure of the compressor and opening a control circuit for the operation of the compressor when the detected value exceeds a predetermined level (26 kg/cm$^2$, for example), in order to avoid the operation of the air conditioning system when the discharge pressure of the compressor exceeds the allowable discharge pressure level. Thus air conditioning systems are rendered inoperative if the discharge pressure of the compressor exceeds a predetermined level. Accordingly, in the example referred to hereinabove, the air conditioning system is rendered inoperative and its cooling capability is reduced to zero when the outdoor temperate exceeds 47° C. (and the discharge pressure of the compressor becomes higher than 26 kg/cm$^2$).

An air-cooled air conditioning system for general use, such as for effecting space cooling in a household in a temperate region, would be quite acceptable for users if it could operate up to a maximum outdoor temperature of 47° C. However, in special cases, the need would arise to use such air conditioning system in areas of torrid heat or in places of high temperature atmosphere. In such cases, air conditioning systems of the prior art have hitherto presented the problem of having to stop operating when the temperature has exceeded a certain level.

To solve this problem, the refrigerant used may be replaced by a different type of refrigerant which has a lower saturation pressure (or condensing pressure) relative to the condensing temperature, or the difference between the condensing temperature of the refrigerant and the temperature of cooling air at the cooling air inlet may be reduced.

When the solution advanced in the former proposal is atopted or when R-12 ($CL_2F_3$) is used as a refrigerant, the saturation pressure (or condensing pressure) relative to the condensing temperature is reduced. However, since R-12 has a lower latent heat of evaporation than R-22, the amount of heat given off at the condenser by R-12 is smaller than the amount of heat given off by R-22 if the same quantity of refrigerant circulates through the system, thereby lowering the cooling capability of the system. This makes it necessary to use a compressor capable of discharging a larger quantity of refrigerant, if it is desired to obtain the same cooling capability.

When the solution advanced in the latter proposal is adopted, the amount of heat given off at the condenser by the refrigerant is also reduced if the difference between the condensing temperature of the refrigerant and the temperature of cooling air at the cooling air inlet is reduced. As a result, the cooling capability of the air conditioning system is lowered, so that it is necessary to increaase the heat transfer area of the compressor if it is desired to obtain the same cooling capability.

Thus it will be apparent that it is desired to keep an air conditioning system in operation even when the outdoor temperature has risen to an abnormally high level, either the compressor or the condenser should have an increased size. However, the solutions described hereinabove are unable to achieve completely satisfactory results. More specifically, if R-12 is used in place of R-22, the evaporating pressure in the evaporator is reduced, with a result that the compression ratio is increased with the volume efficiency of the compressor is lowered, or the temperature of discharge refrigerant in gaseous state rises and the service life of the compressor is shortened. In the case of the latter solution, an increase in the heat transfer area hampers the realization of a reduction in the overall size of an air conditioning system, thereby causing economic losses.

Another solution for obviating the aforementioned problems is disclosed in Japanese Utility Model Publication No. 13735/69, which discloses a system comprising a main circuit including a compressor, a condenser, pressure reducing means and an evaporator, and a bypass circuit connecting a point in the main circuit between the condenser and pressure reducing means to a suction port of the compressor. The bypass circuit includes an expansion valve adapted to be controlled by a heat sensitive member, mounted close to the condenser, in such a manner that the expansion valve opens when the heat sensitive member detects an inordinate rise in the temperature of the condenser, and an ancillary heat exchanger mounted close to the condenser. In this system, the expansion valve of the bypass circuit opens when the temperature in the condenser is elavated as a result of an inordinate rise in outdoor temperature, so that a portion of the refrigerant is allowed to flow through the bypass circuit and to be evaporated at the ancillary heat exchanger to cool the condenser by the heat of vaporization of this portion of the refrigerant, thereby preventing an abnormal rise in condensing pressure.

Some disadvantages are associated with the aforementioned system. In as much as the condenser and the ancillary heat exchanger are merely mounted close to each other, the refrigerant in the ancillary heat exchanger and the refrigerant in the condenser are subjected to indirect heat exchange through air or fins. Thus the system is low in efficiency and the provision of the ancillary heat exchanger is tantamount to an increase in the size of the condenser when the system as a whole is considered. Thus the solution advanced in this patent publication makes it impossible to obtain an overall compact size in an air conditioning system.

On the other hand, when the indoor temperature is low and consequently the cooling load is low, it has hitherto been common practice in air conditioning systems of the prior art to detect the room temperature by means of a thermostat mounted in a typical position in the room. If the detected temperature becomes lower than the previously set lower limit of room temperature, a circuit for controlling the operation of the compressor is opened and the operation of the system is interrupted, with the compressor being driven again when the room temperature has risen above the upper limit of room temperature.

The aforementioned air conditioning systems of the prior art have disadvantages in that, since the compressor is frequently turned on and off, there are large fluctuations in room temperature and the room is not comfortable to live in, and the compressor tends to develop failure.

As an another example, in an air conditioning system of a large capacity, a plurality of refrigeration cycles are provided in the system and some of the cycles are rendered inoperative under low cooling load. This system has both a merit and a demerit. By alternatingly rendering inoperative the refrigeration cycles, it is possible to reduce the frequency at which the same compressor is turned on and off. However, the provision of a plurality of refrigeration cycles renders the construction of the system complex and the weight thereof heavy.

As an another example, for coping with a reduction in cooling load, a proposal has been made to provide a bypass circuit having a bypass valve and connecting the discharge side of the compressor to the suction side thereof, the bypass valve being opened to permit a portion of the refrigerant to flow through the bypass circuit to lower the cooling capability of the system when the cooling load is lowered and the pressure at the suction side of the compressor is reduced below a certain level. This system has, however, a disadvantage in that, if a large quantity of refrigerant is passed to the bypass circuit, the refrigerant is a gaseous state sucked into the compressor shows a rise in temperature and the temperature of a motor coil in the compressor rises. Thus this proposal is not capable of effecting satisfactory capacity control (to lower the cooling capability of the system).

Another proposal is made, as disclosed in U.S. Pat. No. 3,665,725, to lower the cooling capability of an air conditioning system by directly supplying to the evaporator a portion of the refrigerant of high pressure in a gaseous state from the discharge side of the compressor. This proposal is effective to lower the capability of the evaporator to absorb heat. However, the evaporative temperature rises as the cooling capability of the evaporator is lowered, and this makes it impossible for the evaporator to achieve a desired effect in dehumidifying air in the room.

An object of this invention is to provide an air conditioning system which can be continuously operated by preventing an inordinate rise in condensing temperature without requiring to increase the size of the compressor or condenser, when outdoor temperature is relatively high.

Another object of the present invention is to provide an air conditioning system including a compact heat exchanger which permits a refrigerant on the high pressure section of the refrigeration circuit to be cooled efficiently by using a portion of the refrigerant when the pressure in the high pressure section of the refrigeration circuit or condensing pressure shows an inordinate rise.

Still another object of the invention is to provide an air conditioning system which is capable of efficiently effecting capacity control when a cooling load is low.

A further object is to provide an air conditioning system which can lower its cooling capacity without reducing its dehumidifying effect at low cooling load.

According to the invention, there is provided an air conditioning system comprising a compressor, means for condensing a refrigerant through heat exchange without outdoor air, first pressure reducing means, means for evaporating the refrigerant through heat exchange with air to be conditioned, piping connecting these parts together to form a closed main circuit for the refrigerant, and a bypass circuit connecting a high pressure section of said main circuit extending from said condenser means to said first pressure reducing means to a section of said main circuit extending from said evaporator means to said compressor, said bypass circuit including means for controlling the flow of the refrigerant, second pressure reducing means, and heat exchanger means for causing heat exchange to take place between a portion of the refrigerant flowing through the high pressure section of said main circuit extending from the compressor to the first pressure reducing means and a portion of the refrigerant having had its pressure reduced at the second pressure reducing means.

Figure 9A:
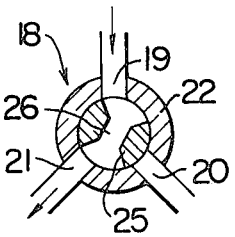
Figure 9B:
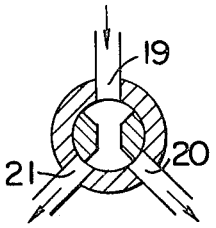
Figure 8:
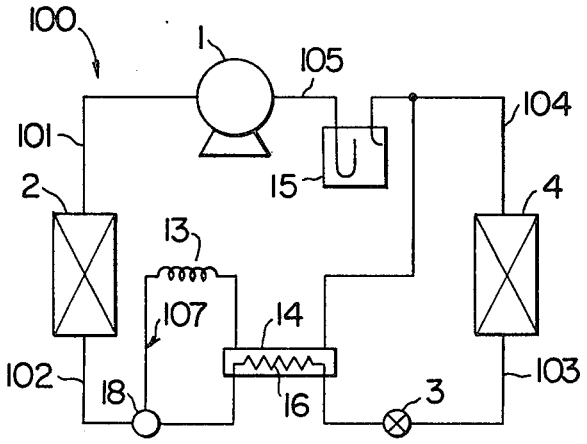
FIG. 8 is a systematic view of still another embodiment.
Figure 9C:
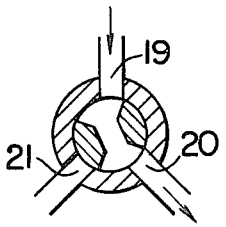
Figure 10:
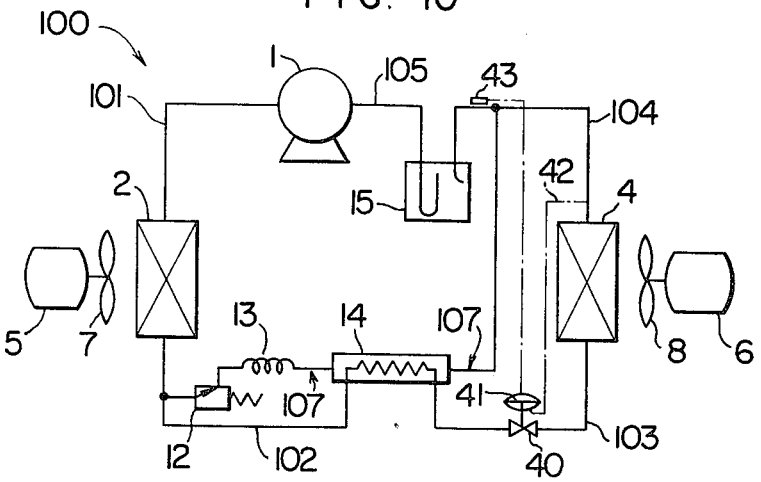
Figure 11:
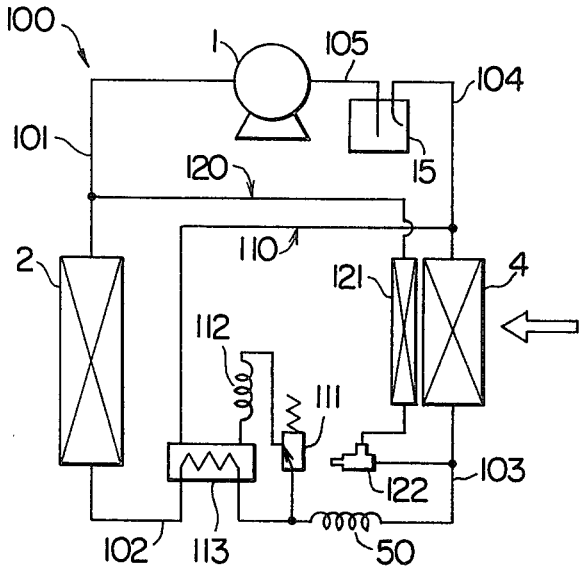
Figure 12:
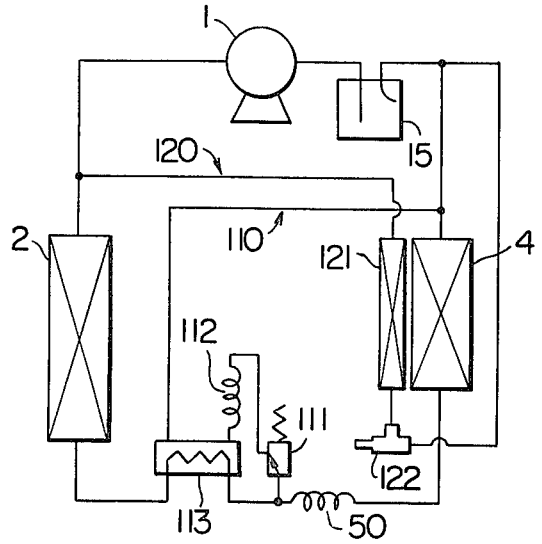
Figure 13:
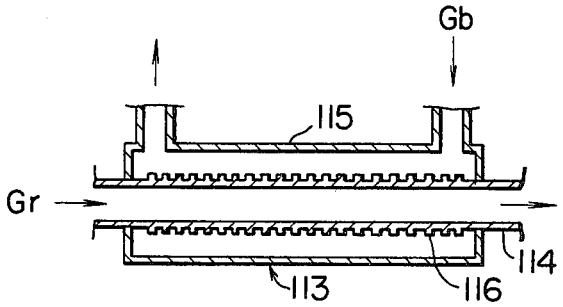
Figure 14:
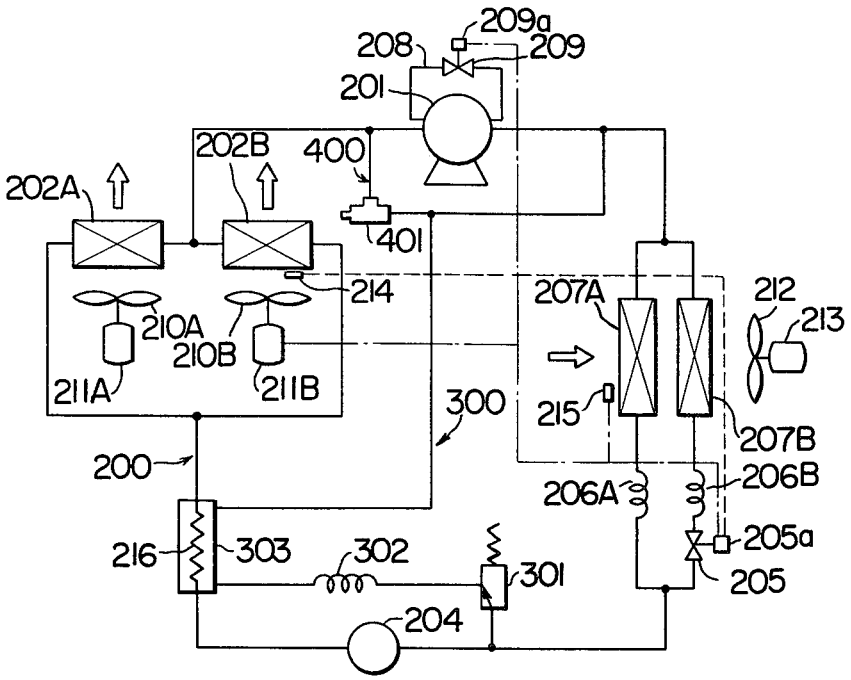
Figure 15:
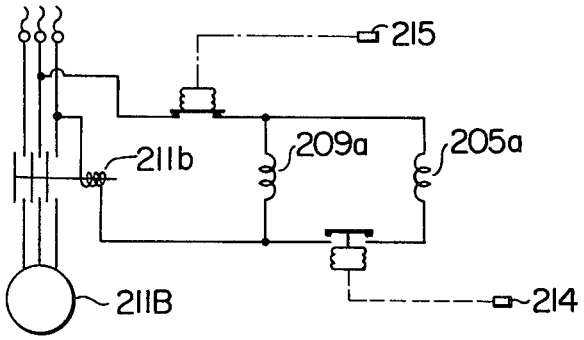
Figure 16:
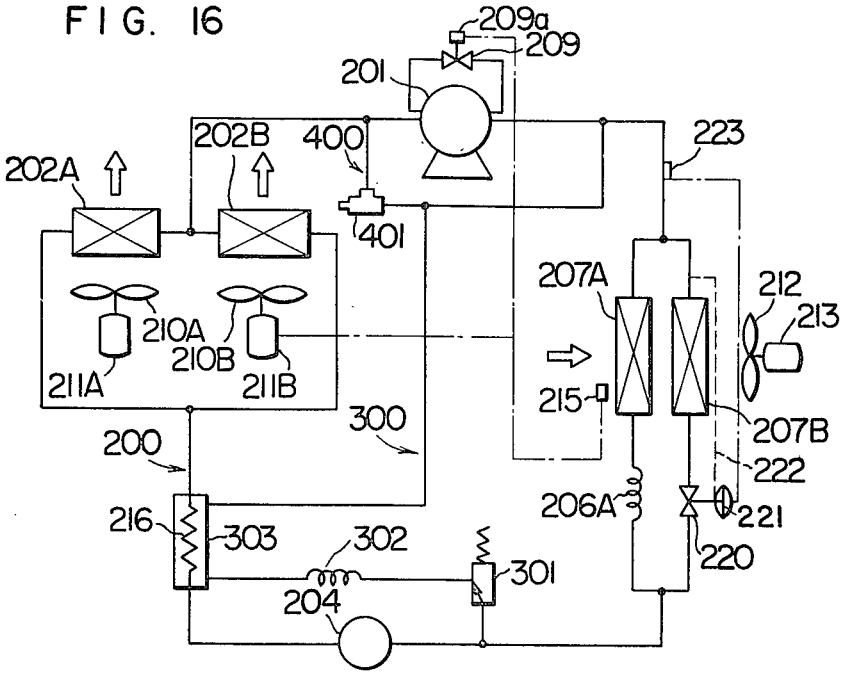
Figure 17:
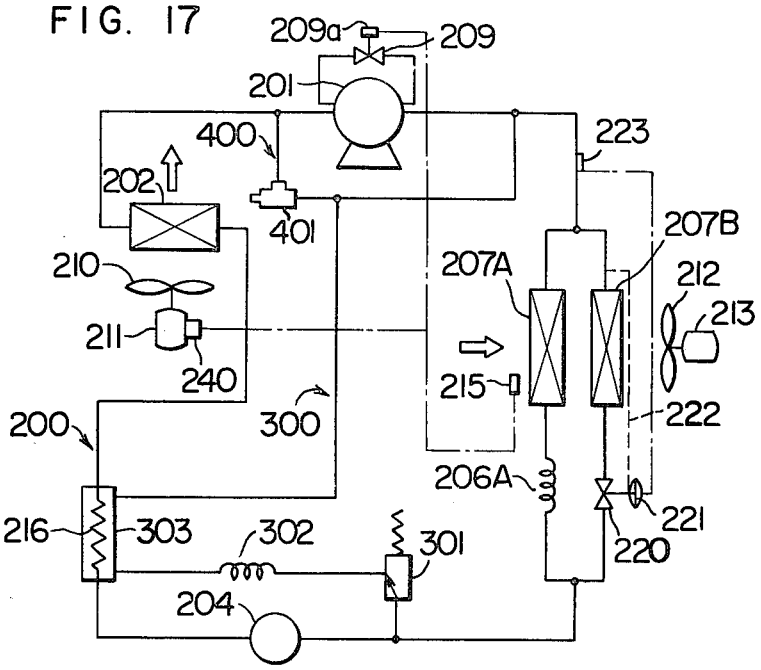

FIGS. 9*a*, 9*b* and 9*c* are views in explanation of the operation of the flow distributor used in the embodiment shown in FIG. 8;

FIG. 10 is a systematic view of still another embodiment;

FIGS. 11 and 12 are systematic views of other embodiments having means for effecting capacity control at low load;

FIG. 13 is a sectional view of the heat exchanger used in the embodiment shown in FIG. 11;

FIG. 14 is a systematic view of still another embodiment;

FIG. 15 is a diagram of the electric control circuit for the embodiment shown in FIG. 14; and FIGS. 16 and 17 are systematic views of modifications of the embodiment shown in FIG. 14.

Figure 1:
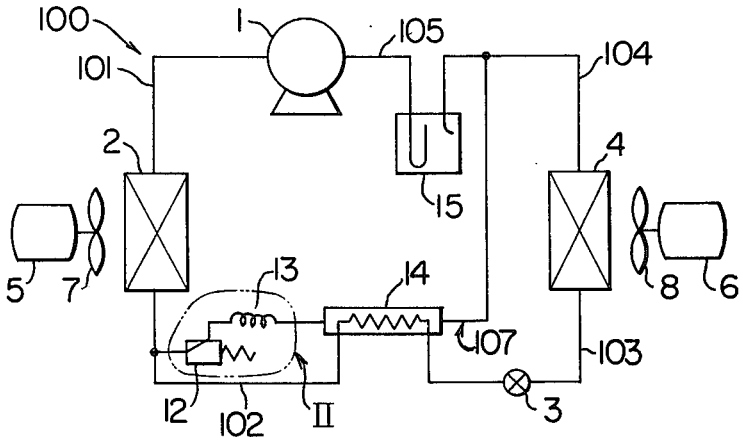
FIG. 1 is a systematic view of one embodiment of the present invention.

In FIG. 1, there is shown an air conditioning system comprising one embodiment of the invention and using R-22 as a refrigerant. The system comprises a closed main circuit 100 including a compressor 1, a condenser 2, pressure reducing means 3, an evaporator 4, a suction accumulator 15, and lines 101, 102, 103, 104 and 105 connecting the aforesaid parts together for permitting the refrigerant to flow therethrough. Disposed close to the condenser 2 are a fan 7 and a motor 5 for driving the fan 7 for supplying outdoor air to the condenser 2. Disposed close to the evaporator 4 are a fan 8 and a motor 6 for driving the fan 8 for supplying to the evaporator air to be cooled. All the parts of the main circuit 100 are designed to operate normally when outdoor temperature is below 47° C. More specifically, the compressor 1 has an allowable discharge pressure of 26 kg/cm$^2$ and is designed such that condensing pressure is kept at about 25 kg/cm$^2$ and discharge pressure does not exceed 26 kg/cm$^2$when outdoor temperature is below 47° C. Although not shown, there is provided means for rendering the compressor 1 inoperate when its discharge pressure exceeds 26 kg/cm$^2$, as is the case with air conditioning systems of the prior art.

In addition to the main circuit 100, a bypass circuit 107 is provided in this embodiment. The bypass circuit 107 connects the line 102 between the condenser 2 and pressure reducing means 3 to the line 104 between the evaporator 4 and suction accumulator 15, and includes a relief valve 12, pressure reducing means 13 and a heat exchanger 14 arranged in the indicated order from the high pressure section of the main circuit 100.

Figure 3:
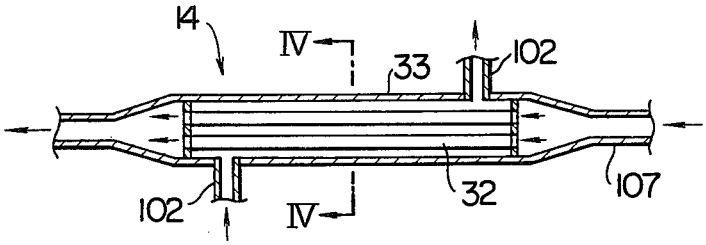
FIG. 3 is a sectional view, on an enlarged scale, of the heat exchanger 14 used in the embodiment shown in FIG. 1.
Figure 4:
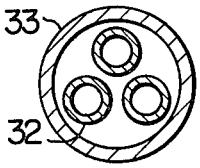
FIG. 4 is a sectional view as viewed in the direction of arrows IV—IV in FIG. 3.

The heat exchanger 14, which is adapted to cause heat exchange to take place between the refrigerant flowing through the line 102 of the main circuit 100 and the refrigerant flowing through the bypass circuit 107, includes inner tubes 32 and an outer tube 33 as shown in FIGS. 3 and 4. The line 102 of the main circuit 100 opens in the cylindrical surface of the outer tube 33 so that the refrigerant in the main circuit 100 flows outside the inner tubes 32. Meanwhile the bypass circuit 107 is connected to opposite ends of the outer tube 33, so that the refrigerant in the bypass circuit 107 flows inside the inner tubes 32. Thus heat exchange directly takes place between the refrigerant in the main circuit 100 and the refrigerant in the bypass circuit 107 through the walls of the inner tubes 32. Heat exchange can take place efficiently. The heat exchanger 14 is not limited to the one shown in the drawings, and any type of heat exchanger may be used so long as heat exchange takes place through walls of a good thermal conducting material between the refrigerant in the main circuit 100 and the refrigerant in the bypass circuit 107.

The relief valve 12 is of a type which is closed when the pressure in the inlet or the pressure within the line 102 is below a set level and opens when the pressure within the line 102 exceeds the set level. The relief valve 12 has a set value which is equal to the pressure (25 kg/cm$^2$ in this embodiment) within the line 102 slightly lower than the allowable value of the discharge pressure (26 kg/cm$^2$) of the compressor 1.

Figure 2:
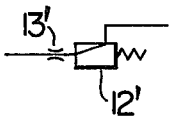
FIG. 2 shows a modification of a portion designated by II in FIG. 1.

In the embodiment shown, the pressure reducing means 13 in the form of a capillary tube is disposed downstream of the relief valve 12. It is to be understood that in place of the combination of the relief valve 12 and the capillary tube, a relief valve 12' formed therein with an orifice 13' integrally therewith as shown in FIG. 2 may be used.

The operation of the air conditioning system shown in FIG. 1 will now be described. The relief valve 12 is normally closed, and the refrigerant circulates through the closed main circuit 100 including the compressor 1, condenser 2, heat exchanger 14, expansion valve 3, evaporator 4, and suction accumulator 15 to repeat the refrigeration cycle.

Assume that outdoor temperature rises to an inordinately high level and the cooling capacity of the condenser 2 markedly drops. At this time, the condensing pressure of the refrigerant in the condenser 2 rises and may exceed 25 kg/cm$^2$. If the condensing pressure exceeds 25 kg/cm$^2$, then the relief valve 12 of the bypass circuit 107 opens, and a portion of the refrigerant changed into a liquid state at the condenser 2 begins to flow into the bypass circuit 107. The refrigerant flowing into the bypass circuit has its pressure reduced at the pressure reducing means 13 and is introduced into the heat exchanger 14 where it cools the refrigerant in the liquid state flowing in the main circuit 100 while being evaporated.

As the refrigerant flowing through the bypass circuit cools at the heat exchanger 14 the refrigerant flowing through the main circuit 100, the heat exchanger 14 performs the same function as the condenser 2 in the main circuit 100. This is tantamount to an increase in the capability of the condenser 2, so that the condensing pressure is lowered. Also, since a portion of the refrigerant flows through the bypass circuit 107, there is a reduction in the quantity of the refrigerant flowing through the pressure reducing means 3 and evaporator 4 of the main circuit 100, resulting in a reduction in evaporating pressure. The condensing pressure in the condenser 2 is reduced by this phenomenon too. Thus even if outdoor temperature exceeds 47° C., the condensing pressure is kept at substantially 25 kg/cm$^2$, and the compressor 1 continuously operates because its discharge pressure does not exceed the allowable pressure of 26 kg/cm$^2$. The refrigerant flowing through the bypass circuit 107 joins the refrigerant in the line 104 and enters the suction accumulator 15 where the refrigerant in the gaseous state is completely separated from the refrigerant in the liquid state and sucked into the compressor 1.

In the embodiment constructed as aforementioned, a rise in condensing pressure can be prevented when there is an inordinate rise in outdoor temperature by causing the refrigerant to flow through the bypass circuit 107 and cool the refrigerant in the high pressure section of the main circuit, so that it is possible to continuously operate the compressor in spite of the rise in outdoor temperature. Since the heat exchanger 14 enables direct heat exchange to take place between a portion of the refrigerant and another portion of the refrigerant, the heat exchanger 14 has a much higher heat transfer efficiency than the ancillary heat exchanger disclosed in Japanese Patent Publication No. 13735/69, thereby making it possible to obtain an overall compact size in an air conditioning system.

Figure 5:
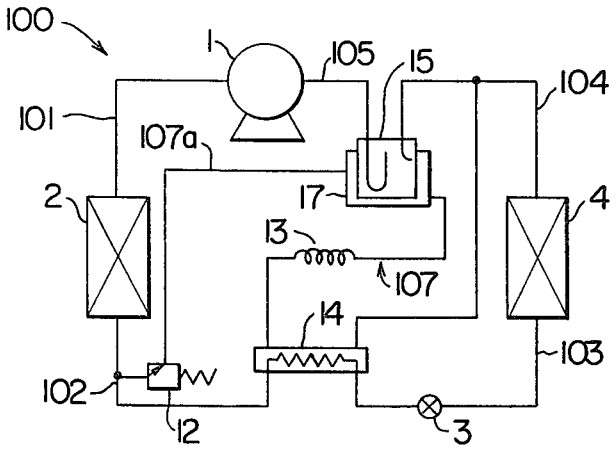
FIGS. 5 and 6 are systematic view of other embodiments of the invention different from the embodiment shown in FIG. 1.

FIG. 5 shows an embodiment of the invention obtained by modifying a part of the embodiment shown in FIG. 1. The embodiment shown in FIG. 5 differs from the embodiment shown in FIG. 1 in that a jacket 17 is mounted at the outside of the suction accumulator 15 and connected midway in a line 107*a* between the relief valve 12 and pressure reducing means 13 of the bypass circuit 107. This embodiment offers the following additional advantage.

In case the refrigerant flowing through the bypass circuit 107 is too high in flow rate, the refrigerant will not be completely evaporated in the heat exchanger 14, and the refrigerant will in part flow in a liquid state into the suction accumulator 15 where it will be separated from the refrigerant in a gaseous state. With the refrigerant in a liquid state of relatively high temperature flowing into the jacket 17 outside the suction accumulator 15, the refrigerant in a liquid state within the suction accumulator will be heated and evaporated. This ensures that no refrigerant in a liquid state is returned to the compressor 1.

Figure 6:
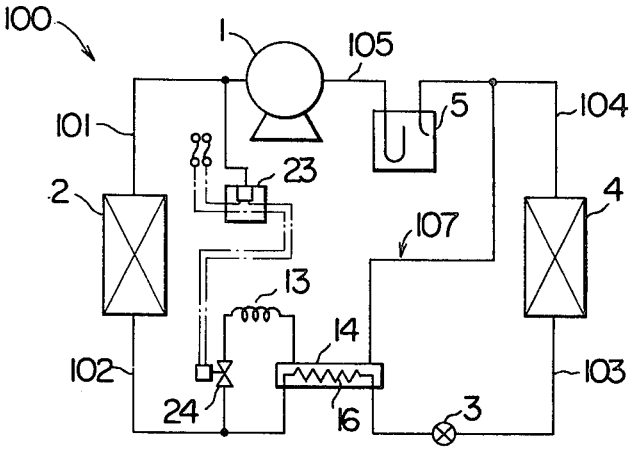

FIG. 6 shows another modification of the embodiment shown in FIG. 1. In the embodiment shown in FIG. 6, an electromagnetic valve 24 is used in place of the relief valve 12, and a pressure switch 23 is provided to control the electromagnetic valve 24. The pressure switch 23 acts such that it opens the electromagnetic valve 24 when the pressure prevailing in the discharge side of the compressor 1 exceeds a predetermined value.

Figure 7:
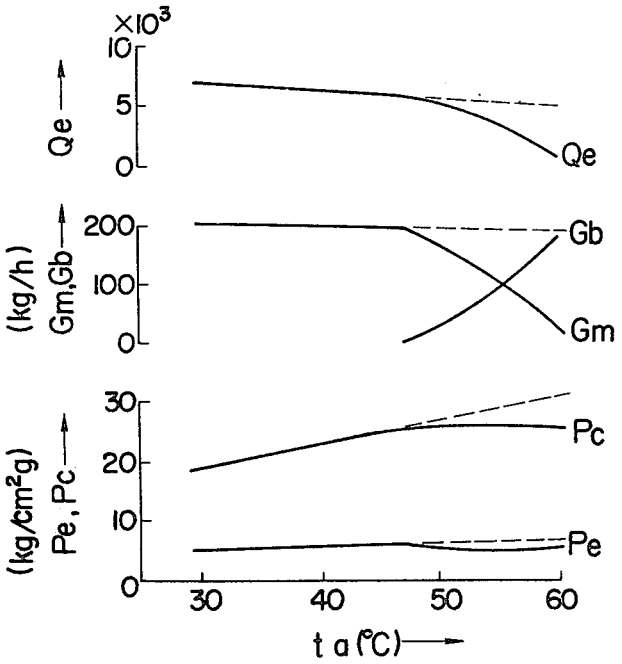
FIG. 7 is a graph showing the preferable flow rate characteristic of a refrigerant flowing through the bypass circuit with respect to outdoor temperature and the relationship between the evaporating pressure, condensing pressure, flow rate of the refrigerant flowing through the evaporator, and cooling capability and the prevailing outdoor temperature.

In all the embodiments shown and described hereinabove, the valve mounted in the bypass circuit is merely intended to open and close the bypass circuit and is not designed to gradually increase or decrease the quantity of refrigerant flowing through the bypass circuit. Thus when the valve is open, the quantity of refrigerant flowing through the bypass circuit is kept substantially constant irrespective of the level of outdoor temperature. However, the quantity of refrigerant flowing through the bypass circuit is preferably increased gradually as outdoor temperature rises. FIG. 7 shows a desirable relation between outdoor temperature and the flow rate (Gb) of refrigerant through the bypass circuit, and the evaporating pressure (Pe), condensing pressure (Pc) and the flow rate (Gm) of refrigerant through the evaporator of the main circuit that are obtained when the desirable relation is established between outdoor temperature and the flow rate (Gb).

The embodiment shown in FIG. 8 has been developed for obtaining the characteristic shown in FIG. 7. In place of the relief valve 12 shown in FIG. 1, a flow distributor 18 controlled by outdoor temperature is mounted at the junction of the main circuit 100 and the bypass circuit 107. As shown in FIGS. 9*a*, 9*b* and 9*c*, the flow distributor 18 includes a cylindrical body 22 formed with three ports 19, 20 and 21, and a rotor 25 rotatable within the bore of the cylindrical body 22. Port 19 communicates with the line connected to the condenser 2; port 20 with the bypass circuit; and port 21 with the line connected to the pressure reducing means 3. The rotor 25 is formed with a passage 26 extending axially therethrough for communicating port 19 with either port 20 or 21 or both of them depending on the position in which the rotor 25 is disposed during its rotation. The rotor 25 is connected to drive means (not shown) for rotating the same to a suitable position in confirmity with outdoor temperature. When outdoor temperature is below about 47° C. (and consequently condensing pressure is below 25 kg/cm$^2$), the drive means keeps the rotor 25 in the position shown in FIG. 9*a* in which port 19 communicates with port 21 only. As outdoor temperature subsequently rises, the drive means rotates the rotor gradually counterclockwise to move to the positions shown in FIGS. 9*b* and 9*c*. In this embodiment, port 19 of the flow distributor 18 communicates with port 21 only, when outdoor temperature is below about 47° C., so that the refrigerant only circulates through the main circuit. A rise in outdoor temperature above 47° C. causes the rotor 25 of the flow distributor 18 to rotate counterclockwise to bring port 19 into communication with both ports 20 and 21. This results in the refrigerant flowing from the condenser 2 being passed on to the bypass circuit 107 too. A further rise in outdoor temperature causes the rotor 25 to further rotate to increase the quantity of refrigerant flowing into the bypass circuit 107, with an attendant decrease in the quantity of refrigerant flowing to the pressure reducing means 3 of the main circuit. When the rotor 25 has rotated to the position shown in FIG. 9*c*, all the refrigerant flows into the bypass circuit. In this way, the refrigerant flow rate characteristic relative to outdoor temperature as shown in FIG. 7 can be obtained. It is to be understood that in place of controlling the position of the rotor 25 in accordance with outdoor temperature, the position of the rotor 25 may be controlled in accordance with the condensing pressure of the refrigerant.

In the embodiment shown in FIG. 10, the proportions of the flow rates of refrigerant passing through the bypass circuit and the pressure reducing means 40 of the main circuit are controlled by the pressure reducing means 40 of the main circuit which is in the form of an expansion valve of the maximum operating pressure type. The expansion valve 40 includes a diaphragm 41 for controlling the degree of opening of the valve. The pressure of refrigerant prevailing at the outlet of the evaporator 4 acts on one side of the diaphragm 41 through a pressure equalizing tube 42, and the pressure of a fluid in a thermal tube 43 mounted downstream of the junction of the bypass circuit and the line 104 of the main circuit acts on the other side of the diaphragm 41. The thermal bulb 43 used with the expansion valve 40 of the maximum operating pressure type has a characteristic such that it produces an internal pressure which is commensurate with a detected temperature when the temperature is below a predetermined temperature, but produces a constant internal pressure when the temperature is above the predetermined temperature. In this embodiment, the predetermined temperature of the thermal bulb is set at a temperature which is detected by the thermal bulb 43 when the relief valve 12 opens. The degree of opening of the expansion valve 40 increases when the internal pressure of the thermal bulb 43 rises or the internal pressure of the pressure equalizing tube 42 falls. The embodiment shown in FIG. 10 is similar to the embodiment shown in FIG. 1 except for the construction of the pressure reducing means of the main circuit. It is to be understood, however, that the embodiment shown in FIG. 10 is designed such that the bypass circuit 107 has a fluid resistance so as to enable only a small quantity of refrigerant to flow therethrough when the expansion valve 40 of the main circuit is fully open.

The operation of the embodiment shown in FIG. 10 will now be described. When outdoor temperature is below 47° C., condensing pressure is kept below 25 kg/cm$^2$ and the relief valve 12 is closed. However, if outdoor temperature rises and condensing pressure exceeds 25 kg/cm$^2$, then the relief valve 12 opens. At this time, the evaporator 4 is faced with a demand to have a high cooling capacity, and the expansion valve 40 is substantially fully open. Accordingly, only a small quantity of refrigerant flows through the bypass circuit 107 after the relief valve 12 has opened, with the majority of refrigerant flowing through the expansion valve 40 and evaporator 4 of the main circuit. A further rise in outdoor temperature results in a rise in condensing pressure, with a result that the pressure at the outlet side of the evaporator 4 increases and the temperature detected by the thermal bulb 43 rises. Since the temperature detected by the thermal bulb 43 exceeds the temperature at which the thermal bulb 43 is set, there occurs no change in the internal pressure of the thermal bulb 43 and hence there is no change in the pressure acting on the upper side of the diaphragm 41. Thus the increase in the pressure prevailing at the outlet side of the evaporator 4 which acts on the lower side of the diaphragm 41 causes the diaphragm 41 to be displaced upwardly, thereby decreasing the degree of opening of the expansion valve 40. As a result, the quantity of refrigerant flowing through the expansion valve 40 of the main circuit is reduced, and the quantity of refrigerant flowing through the bypass circuit 107 increases. In this manner, the quantity of refrigerant flowing through the bypass circuit 107 increases as outdoor temperature rises, and a characteristic similar to the characteristic shown in FIG. 7 can be obtained.

In all the embodiments shown and described hereinabove, the bypass circuit 107 branches off the main circuit from a point between the condenser 2 and heat exchanger 14. It is to be understood, however, that the bypass circuit may branch off the main circuit at the line connecting the heat exchanger 14 and the pressure reducing means of the main circuit.

FIG. 11 shows another embodiment which differ from the embodiments shown and described hereinabove. The embodiment shown in FIG. 11 possesses a capacity control function to enable the air conditioning system to operate continuously even at low load. In this embodiment too, the compressor 1, condenser 2, pressure reducing means 50, evaporator 4 and suction accumulator 15 are interconnected by the lines 101, 102, 103, 104 and 105 to provide the closed main circuit 100. A first bypass circuit 110 connects a point upstream of the pressure reducing means 50 of the main circuit 100 to a point downstream of the evaporator 4 of the main circuit 100, and includes a relief valve 111, pressure reducing means 112 and a heat exchanger 113. As shown in FIG. 13, the heat exchanger 113 includes an inner tube 114 communicating with the line 102 of the main circuit 100, and an outer tube 115 communicating with the bypass circuit 110. Heat exchange takes place through the wall of the inner tube 114 between the refrigerant flowing through the main circuit 100 and the refrigerant flowing through the bypass circuit 110. The inner tube 114 has a multitude of fins 116 extending from its outer periphery. The first bypass circuit 110 has, like the bypass circuits of the embodiments shown and described hereinabove, the function of cooling the refrigerant flowing through the line 102 of the main circuit 100 and lowering the condensing pressure of refrigerant when the condensing pressure of refrigerant shows an inordinate rise. Preferably, the ratio $G_r/G_B$ of the flow rate $G_r$ of refrigerant flowing through the main circuit to the flow rate $G_B$ of refrigerant flowing through the first bypass circuit is 2 to 3. When $G_r/G_B=2$ to 3, it is preferable to set the ratio $A_i/A_o$ of the inner heat transfer area $A_i$ of the inner tube 114 to the outer heat transfer area $A_o$ thereof at $\frac{1}{3}$ to $\frac{1}{2}$, in order that heat exchange may take place effectively in the heat exchanger 113. That is, if the product of the heat transfer area and the flow rate of refrigerant at the inside of the inner tube 114 is equal to the product of the heat transfer area and the flow rate of refrigerant at the outside of the inner tube, it is possible to maximize the heat transfer efficiency and reduce the size of the heat exchanger.

The embodiment shown in FIG. 11 further includes a second bypass circuit 120 for effecting capacity control of the system, in addition to the first bypass circuit 110. The second bypass circuit 120 connects a point in the main circuit 100 upstream of the condenser 2 to a point in the main circuit 100 downstream of the pressure reducing means 50, and includes a reheater 121 and a bypass valve 122. The reheater 121 is arranged such that it is close to the evaporator 4 of the main circuit and comes into contact with the air cooled in the evaporator 4. The bypass valve 122 is adapted to open when the pressure in the line 103 of the main circuit 100 (substantially equal to the internal pressure of the evaporator 4) drops below a certain set value. The value of pressure set for the bypass valve 122 is the evaporating pressure of the refrigerant when the cooling load applied to the evaporator 4 becomes abnormally low. When the refrigerant is R-22, the set pressure value is about 4.0 kg/cm$^2$g. The bypass valve 122 contains therein a pressure reducing means for causing a suitable pressure drop in the refrigerant passing therethrough.

The operation of the embodiment shown in FIG. 11 will now be described. In normal operating condition, both the relief valve 111 and bypass valve 122 are closed, and the refrigerant only flows through the main circuit 100 to repeat the refrigeration cycle. When outdoor temperature shows an inordinate rise, however, a rise in condensing pressure causes the relief valve 111 to open, thereby causing a portion of the refrigerant to flow through the first bypass circuit 110 and cool in the heat exchanger 113 the refrigerant flowing through the main circuit 100. This prevents a rise in condensing pressure, permitting the system to continue its operation.

On the other hand, when outdoor temperature and room temperature drop and consequently the cooling load becomes lower, the pressure of the refrigerant in the evaporator 4 becomes lower. Upon the pressure prevailing in the line 103 becoming below the value of pressure set for the bypass valve 122, the bypass valve 122 opens and a portion of the refrigerant of high pressure and high temperature in a gaseous state discharged from the compressor begins to flow into the second bypass circuit 120. The refrigerant introduced into the second bypass circuit 120 flows into the reheater 121 where a portion of the refrigerant heats the air cooled in the evaporator 4 while the refrigerant condenses. The refrigerant that has passed through the second bypass circuit 120 is introduced into the evaporator 4 to raise the pressure therein. Since the air cooled in the evaporator 4 is reheated and the evaporating pressure in the evaporator 4 rises as aforesaid, the cooling capability of the system is lowered. Thus when the cooling load drops, it is possible to continuously operate the air conditioning system by causing a portion of the refrigerant to flow through the second bypass circuit 120 to thereby lower the cooling capacity. This eliminates the need to interrupt the operation of the compressor often. Since the room air is cooled in the evaporator 4 and then heated to a predetermined temperature in the reheater 121, the evaporator 4 can achieve superb results in dehumidifying the air, so that air of low moisture content can be obtained and refreshing air can be provided by air conditioning.

The embodiment shown in FIG. 12 is a modification of the embodiment shown in FIG. 11. The difference between the two embodiments lies in the fact that the second bypass circuit 120 is connected at its outlet to a point downstream of the evaporator 4 in the main circuit 100. In this embodiment, the refrigerant flowing through the second bypass circuit 120 bypasses the evaporator 4, so that the pressure in the evaporator 4 can be maintained at a lower level than in the embodiment shown in FIG. 11 and the temperature in the evaporator 4 is low. This increases the dehumidifying capability of the evaporator 4.

FIG. 14 shows an air conditioning system which is capable of effecting control of its cooling capacity more meticulously than the embodiments shown in FIGS. 11 and 12. The air conditioning system has a main circuit 200 including a compressor 201, a pair of condensers 202A and 202B, a receiver 204, a pair of evaporators 207A and 207B, pressure reducing means 206A and 206B mounted on the downstream side of the respective evaporators, and an electromagnetic valve 205 (of the type which is open when a current is passed thereto) for cutting off the supply of refrigerant to one evaporator 207B. The compressor 201, which is of the variable capacity type, includes a plurality of cylinders, a passage 208 interconnecting a suction line and a discharge line of some of the plurality of cylinders, and an electromagnetic valve 209 (of the type which is closed when a current is passed thereto) for opening and closing the passage 208. Disposed close to the condensers 202A and 202B are fans 210A and 210B for supplying outdoor air thereto and motors 211A and 211B for driving the fans 210A and 210B respectively. Disposed close to the evaporators 207A and 207B are a fan 212 and a motor 213 for supplying indoor air to the evaporators 207A and 207B. A thermostat 214 is mounted close to the condenser 202B and connected to the electromagnetic valve 205 for interrupting the supply of a current to a coil **205*a* of the electromagnetic valve 205 to close the latter when a temperature (Tu) for which the thermostat 214 is set is detected. Mounted in a room in which air conditioning is to be effected is another thermostat 215 which is connected to the electromagnetic valves 205 and 209 and motor 211B for opening electromagnetic valve 209 and closing electromagnetic valve 205 and stopping the operation of motor 211B when the temperature in the room is reduced below a temperature ($T_L$) set for the thermostat 215. FIG. 15 shows an electric control circuit of the embodiment, in which the coils 205*a*, 209*a* and a switch 211*b* of the motor 211B are controlled by the thermostats 214 and 215**.

The air conditioning system further includes a first bypass circuit 300 connecting a point in the main circuit 200 downstream of the receiver 204 to the suction side of the compressor 201, and a third bypass circuit 400 connecting the discharge side of the compressor 201 to the suction side thereof. The first bypass circuit 300 includes a relief valve 301 adapted to open when the inlet pressure exceeds a predetermined level, pressure reducing means 302, and a heat exchanger 303 for cooling the refrigerant flowing through the main circuit 200. The third bypass circuit 400 further includes a bypass valve 401 adapted to open when the suction pressure of the compressor is reduced below a predetermined level.

The operation of the air conditioning system shown in FIG. 14 will now be described. When the system operates under normal cooling load conditions, the electromagnetic valve 205 is open, the electromagnetic valve 209, relief valve 301 and bypass valve 401 are closed, and the refrigerant of high temperature and high pressure in a gaseous state discharged from the compressor 201 is introduced into the condensers 202A and 202B, where heat exchange takes place between the refrigerant gas and outdoor air supplied by the fans 210A and 210B driven by the motors 211A and 211B respectively so as to change the refrigerant into a liquid state. After passing through the receiver 204, a portion of the refrigerant in a liquid state is introduced into the pressure reducing means 206A and the rest of the refrigerant passes through the electromagnetic valve 205 before being introduced into the pressure reducing means 206B. The refrigerant has its pressure reduced at the pressure reducing means 206A and 206B and is introduced into the respective evaporators 207A and 207B while changing into a gaseous state. In the evaporators 207A and 207B, heat exchange takes place between the refrigerant changing into a gaseous state and air circulating in the room and supplied by the fan 212 driven by the motor 213 to the evaporators, so as to cool the air in the room. The refrigerant released from the evaporators 207A and 207B is returned to the compressor 201.

The system operates as follows when outdoor temperature is elevated or the amount of heat generated in the room increases and cooling is effected under overload conditions. If the condensing pressure of the refrigerant at the condensers 202A and 202B rises and exceeds the pressure set for the relief valve 301, then the latter opens to allow a portion of the refrigerant in a liquid state released from the receiver 204 to flow into the first bypass circuit 300. The refrigerant flowing through the first bypass circuit 300 has its pressure reduced at the pressure reducing means 302 and is introduced into the heat exchanger 303 while changing into the gaseous state. In the heat exchanger 303, the refrigerant flowing through the first bypass circuit 300 cools the refrigerant flowing through a high pressure liquid line 216 of the main circuit 200 while further changing into a gaseous state. The result of this is that since a portion of the refrigerant flows through the first bypass circuit 300, the quantity of the refrigerant flowing through the evaporators 207A and 207B is reduced, so that the evaporative pressure of refrigerant is reduced and at the same time the suction pressure of the compressor 201 is also reduced. A reduction in the suction pressure of the compressor 201 results in a reduction in the discharge pressure thereof. The cooling at the heat exchanger 303 of the refrigerant flowing through the high pressure liquid line 216 of the main circuit 200 indicates that the heat exchanger 303 performs the same function as the condensers 202A and 202B. This is tantamount to an increased capability of the condensers 202A and 202B and causes a reduction in condensing pressure.

If outdoor temperature is further elevated and becomes higher than the temperature level at which the system operates as aforementioned, and if condensing temperature rises and exceeds the temperature ($T_u$) set for the thermostat 214, then the thermostat 214 is actuated and cuts off the supply of a current to the coil 205*a* to close the electromagnetic valve 205, thereby interrupting the flow of the refrigerant to the evaporator 207B. When this is the case, a portion of the refrigerant increases the quantity of refrigerant flowing to the evaporator 207A and the rest thereof increases the quantity of refrigerant flowing through the first bypass circuit 300. Even if the quantity of refrigerant flowing to the evaporator 207A increases due to the interruption of the flow of refrigerant to the evaporator 207B, evaporating pressure decreases because the quantity of refrigerant flowing through the evaporator means as a whole is reduced, with a result that the discharge pressure of the compressor 201 is lowered. Moreover, since the quantity of refrigerant flowing into the first bypass circuit 300 increases, the ability to lower discharge pressure is doubly increased.

The system operates as follows when outdoor temperature drops or the amount of heat generated in the room is reduced and cooling is effected under low load conditions. First, when the cooling load is lowered and the temperature of air in the room is reduced below the temperature ($T_L$) set for the thermostat 215, the latter is actuated to cut off the supply of a current to the coil 209*a* to open the electromagnetic valve 209, thereby reducing the quantity of refrigerant actually circulating through the compressor 201. At the same time, actuation of the thermostat 215 cuts off the supply of a current to the coil 205*a* to close the electromagnetic valve 205 to interrupt the introduction of refrigerant into the evaporator 207B, thereby lowering cooling capacity by interrupting the introduction of the refrigerant into the evaporator 207B. If the evaporator 207B were rendered inoperative and evaporating pressure were lowered, the moisture removed from air by the evaporator 207A and drained therefrom would freeze. To cope with this situation, the supply of a current to the fan 211B for driving the fan 210B for supplying outdoor air to the condenser 202B is cut off by the action of the thermostat 215 simultaneously as the supply of a current to the coil 205*a* is cut off. This lowers the capability of the condenser means as a whole, so that the condensing pressure of the refrigerant rises. Since a rise in condensing pressure causes a rise in evaporative pressure, it is possible to prevent freezing of the moisture removed by the evaporator 207A and drained therefrom.

The cooling load may be further lowered and evaporating pressure may not rise sufficiently to keep the suction pressure of the compressor 201 above a critical value. If the suction pressure is reduced below the critical value, the bypass valve 401 of the third bypass circuit 400 opens to cause a portion of the refrigerant of high temperature and high pressure in a gaseous state discharged from the compressor 201 to flow through the third bypass circuit 400 to the suction side of the compressor 201 so as to thereby raise the suction pressure of the compressor 201. A rise in suction pressure naturally results in a rise in the evaporating pressure of the evaporator 207A disposed upstream of the suction side of the compressor 201. Thus freezing of the drain of moisture removed from the indoor air can be prevented with increased efficiency.

It will thus be appreciated that the air conditioning system shown in FIG. 14 is capable of effecting its capacity control at five different levels. That is, the system can operate satisfactorily under normal cooling load conditions, can control its operation so as to cope with two levels of overload conditions, and can control its operation to cope with two levels of low load conditions.

FIG. 16 shows a modification of the embodiment shown in FIG. 14, in which the electromagnetic valve 205 and pressure reducing means 206B shown in FIG. 14 are replaced by an expansion valve 220 of the maximum operating pressure type so as to effect continuous control of the flow rate of refrigerant. The expansion valve 220 has a diaphragm 221 for controlling the degree of opening thereof. The pressure of refrigerant at the outlet of the evaporator 207B acts on one side of the diaphragm 221 through a pressure equalizing tube 222, while the pressure prevailing in a thermal bulb 223 (mounted in a line downstream of the joint of the outlets of evaporators 207A and 207B) acts on the other side of the diaphragm 221. In the expansion valve 220 of the maximum operating pressure type, when the temperature of the thermal bulb 223 rises above a critical level, the pressure of the fluid therein does not rise even if the temperature rises above such level. The critical temperature of the thermal bulb 223 is set at a temperature which is detected by the thermal bulb 223 when the relief valve 301 opens.

The operation of the embodiment shown in FIG. 16 will be described. The operation of the system under overlead conditions will first be described. A rise in outdoor temperature causes a rise in condensing pressure. When condensing pressure exceeds the predetermined level, then the relief valve 301 of the first bypass circuit 300 opens, and a portion of the refrigerant begins to flow into the bypass circuit 300. The refrigerant flowing through the bypass circuit 300 cools, at the heat exchanger 216, the refrigerant flowing through the main circuit 200, thereby preventing the rise in condensing pressure. However, in the event of a further rise in outdoor temperature, flowing of the refrigerant through the bypass circuit 300 has no effect in preventing a further rise in condensing pressure. The further rise in condensing pressure causes a rise in evaporating pressure and hence a rise in the temperature of thermal bulb 223. Since the temperature of thermal bulb 223 is higher than its critical temperature, a rise in the temperature of thermal bulb 223 does not affect the expansion valve 220. Accordingly, the expansion valve 220 is moved toward a closed position by the evaporating pressure transmitted through the pressure equalizing pipe 222, thereby reducing the flow rate of refrigerant passing through the expansion valve 220. This increases the flow rate of refrigerant passing through the first bypass circuit 300, thereby increasing the ability to cool the refrigerant flowing through the main circuit 200. Thus the further rise in condensing pressure is prevented and continuous operation of the compressor 201 is made possible.

The operation of the system under low load conditions will be described. A drop in outdoor temperature results in a reduction in evaporating pressure and the temperature of refrigerant at the outlets of evaporators 207A and 207B. This causes a reduction in the degree of superheating of the refrigerant, and the refrigerant in slightly wet condition soon begins to flow. However, since the expansion valve 220 responds to the evaporative pressure and the temperature of refrigerant detected by the thermal bulb 223 and functions in a manner to keep the degree of superheating of refrigerant constant, the valve 220 moves in a direction in which its degree of opening is reduced in conformity with a reduction in cooling capability. Thus the quantity of refrigerant flowing through the evaporator means as a whole is reduced, so that the system operates with a reduced cooling capability. It will be appreciated that the embodiment shown in FIG. 16 is capable of continuously effecting capacity control in conformity with outdoor temperature.

FIG. 17 shows a modification of the embodiment shown in FIG. 16. The embodiment shown in FIG. 16 has a plurality of condensers, fans and motors for driving the fans, with one of the motors being de-actuated when capacity control of the condenser means is carried out. The embodiment shown in FIG. 17 provides an improvement in the condenser means so as to effect capacity control of the condenser means by using one condenser, one fan and one motor for driving the fan. More specifically, the system includes only the condenser 202, fan 210 and motor 211 for driving the fan 210. The motor 211 has mounted thereon an rpm converter 240 which is connected to the thermostat 215 for detecting indoor temperature, so that the rpm of the motor 211 can be controlled by the rpm converter 240 and thermostat 215. Thus capacity control of the condenser 202 is effected in conformity with indoor temperature. This embodiment offers the advantage of being able to obtain a compact size in the condenser means as compared with the embodiments shown and described hereinabove.

The embodiments shown in FIGS. 14, 16 and 17 have no suction accumulator mounted on the suction side of the compressor. Preferably, a suction accumulator is mounted on the suction side of the compressor as is done in other embodiments, so that only the refrigerant in a gaseous state will be sucked into the compressor.

Although the present invention has been described with reference to various preferred embodiments, it is to be understood that these embodiments are set forth merely by way of example and that the scope of the invention is not to be limited thereto, since many modifications may be made without departing from the spirit and scope of the invention. For example, the heat exchanger for cooling the refrigerant flowing through the main circuit may be mounted upstream of the condenser means.

What is claimed is:

1. An air conditioning system comprising:

a compressor;

means for condensing a refrigerant through heat exchange with outdoor air;

first pressure reducing means;

means for evaporating the refrigerant through heat exchange with air to be conditioned;

piping means fluid connecting said compressor, said means for condensing, said first pressure reducing means and said means for evaporating serially together to form a closed main circuit for the refrigerant; and a bypass circuit means connecting a high pressure section of said main circuit extending from said means for condensing to said first pressure reducing means to a low pressure section of said main circuit extending from said means for evaporating to said compressor;

said bypass circuit means comprising means for controlling the flow of the refrigerant, second pressure reducing means, heat exchanger means for causing heat exchange to take place between a portion of the refrigerant flowing through the high pressure section of said main circuit extending from the compressor to the first pressure reducing means and a portion of the refrigerant flowing through the bypass circuit means having had its pressure reduced at said second pressure reducing means, and said heat exchanger means including a solid heat exchange wall having opposed surfaces, one of said surfaces contacting directly with the refrigerant in said main circuit, and the other of said surfaces contacting directly with the refrigerant flowing through said bypass circuit means, said heat exchanger means comprising a tube in tube type heat exchanger including an outer tube, and an inner tube defining a first passage therein and arranged in said outer tube to define a second passage therebetween, and one of said first and second passages being disposed in said main circuit downstream of said means for condensing and the other of said first and second passages being disposed in said bypass circuit means downstream of said second pressure reducing means so that heat exchange between refrigerants passing through the first and second passages is effected through the inner tube constituting said heat exchanger wall;

said compressor including means for effecting compression capacity control;

said means for condensing including a condenser, and a fan and a variable speed motor associated with said condenser;

said means for evaporating including a pair of evaporators arranged in parallel with each other;

said first pressure reducing means including pressure reducing means mounted upstream of one of said pair of evaporators, and an expansion valve of the maximum operating pressure type, said expansion valve being responsive to the evaporative pressure of the evaporator connected thereto;

a thermal bulb for detecting the temperature of refrigerant at a point downstream of the junction of two streams of refrigerant released from the two evaporators and producing a correlated internal pressure;

said expansion valve further being responsive to the internal pressure of said thermal bulb;

and the air conditioning system further comprises means for controlling said compression capacity in response to the temperature in a room, and control means for controlling the speed of said motor.

2. An air conditioning system as claimed in claim 1, further comprising a third bypass circuit connecting the discharge side of said compressor to the suction side thereof, said third bypass circuit including valve means adapted to open when the pressure at the discharge side of the compressor is lowered below a fixed level.

3. An air conditioning system as claimed in claim 1, wherein said compressor includes means for effecting compression capacity control;

said means for condensing includes a pair of condensers arranged in parallel with each other, and fans and motors forming two sets, with each set being associated with a respective one of the pair of condensers; and said means for evaporating includes a pair of evaporators arranged in parallel with each other.

4. An air conditioning system as claimed in claim 3, further comprising a third bypass circuit connecting the discharge side of said compressor to the suction side thereof, said third bypass circuit including valve means adapted to open when the pressure at the discharge side of the compressor is lowered below a fixed level.

5. An air conditioning system comprising:

a compressor;

means for condensing a refrigerant through heat exchange with outdoor air;

first pressure reducing means;

means for evaporating the refrigerant through heat exchange with air to be conditioned;

piping means fluid connecting said compressor, said means for condensing, said first pressure reducing means and said means for evaporating serially together to form a closed main circuit for the refrigerant; and a bypass circuit means connecting a high pressure section to said main circuit extending from said means for condensing to said first pressure reducing means to a low pressure section of said main circuit extending from said means for evaporating to said compressor;

said bypass circuit means comprising means for controlling the flow of the refrigerant, second pressure reducing means, heat exchanger means for causing heat exchange to take place between a portion of the refrigerant flowing through the high pressure section of said main circuit extending from the compressor to the first pressure reducing means and a portion of the refrigerant flowing through the bypass circuit means having had its pressure reducing at said second pressure reducing means, said heat exchanger means including a solid heat exchange wall having opposed surfaces, one of said surfaces contacting directly with the refrigerant in said main circuit, and the other of said surfaces contacting directly with the refrigerant flowing through said bypass circuit means, said heat exchanger means comprises a tube in tube type heat exchanger including an outer tube, and an inner tube defining a first passage therein and arranged in said outer tube to define a second passage therebetween, one of said first and second passages being disposed in said main circuit downstream of said means for condensing and the other of said first and second passages being disposed in said bypass circuit means downstream of said second pressure reducing means so that heat exchange between refrigerants passing through the first and second passages is effected through the inner tube constituting said heat exchange wall, and said means for controlling the flow of the refrigerant through said bypass circuit means comprises relief valve means opening when the pressure at the inlet of said bypass circuit means that communicates with said main circuit exceeds a fixed pressure and further comprises throttle means in said bypass circuit means upstream of said relief valve to restrict the flow rate of refrigerant passing through said bypass circuit means;

said first pressure reducing means of the main circuit comprising an expansion valve responding to the pressure of refrigerant at the outlet of said means for evaporating;

a thermal bulb for detecting the temperature of refrigerant prevailing at a point downstream of the junction of the main circuit and the bypass circuit means, said thermal bulb being of the type in which an internal pressure commensurate with the detected temperature is generated when the detected temperature is below a fixed level and a constant internal pressure is generated when the detected temperature is above the fixed level;

and said expansion valve further responding to the pressure in said thermal bulb.

6. An air conditioning system as claimed in claim 5, wherein said bypass circuit means is connected to a point between said means for condensing of the main circuit and the heat exchanger means.

7. An air conditioning system as claimed in claim 1 further comprising a third bypass circuit connecting the discharge side of said compressor to the suction side thereof, said third bypass circuit including a valve means adapted to open when the pressure at the discharge side of the compressor is lowered below a fixed level.

8. An air conditioning system as claimed in claim 5, wherein said bypass circuit means is connected to a point between said heat exchanger means and said first pressure reducing means of the main circuit.

9. An air conditioning system as claimed in claim 5, wherein said main circuit includes a suction accumulator mounted between said means for evaporating and said means for compressing, and said bypass circuit means is connected between said means for evaporating and said suction accumulator of the main circuit.

10. An air conditioning system as claimed in claim 5, further comprising a third bypass circuit connecting the discharge side of said compressor to the suction side thereof, said third bypass circuit including valve means adapted to open when the pressure at the discharge side of the compressor is lowered below a fixed level.

11. An air conditioning system as claimed in claim 5, wherein said compressor includes means for effecting compression capacity control;

said means for condensing includes a pair of condensers arranged in parallel with each other, and fans and motors forming two sets, with each set being associated with a respective one of the pair of condensers;

said means for evaporating includes a pair of evaporators arranged in parallel with each other.

12. An air conditioning system as claimed in claim 11, further comprising a third bypass circuit connecting the discharge side of said compressor to the suction side thereof, said third bypass circuit including valve means adapted to open when the pressure at the discharge side of the compressor is lowered below a fixed level.

* * * * *